US008448690B1

(12) United States Patent
Sawtell et al.

(10) Patent No.: US 8,448,690 B1
(45) Date of Patent: May 28, 2013

(54) METHOD FOR PRODUCING INGOT WITH VARIABLE COMPOSITION USING PLANAR SOLIDIFICATION

(75) Inventors: Ralph R. Sawtell, Gibsonia, PA (US); Men Glenn Chu, Export, PA (US)

(73) Assignee: Alcoa Inc., Pittsburgh, PA (US)

( * ) Notice: Subject to any disclaimer, the term of this patent is extended or adjusted under 35 U.S.C. 154(b) by 360 days.

(21) Appl. No.: 12/470,415

(22) Filed: May 21, 2009

Related U.S. Application Data

(60) Provisional application No. 61/055,081, filed on May 21, 2008.

(51) Int. Cl.
*B22D 19/16* (2006.01)

(52) U.S. Cl.
USPC ..... 164/95; 164/96

(58) Field of Classification Search
USPC ..... 164/91, 94, 95, 96, 461, 457
See application file for complete search history.

(56) References Cited

U.S. PATENT DOCUMENTS

| | | | |
|---|---|---|---|
| 2,244,367 | A | 6/1941 | Kinkead |
| 2,301,027 | A | 11/1942 | Ennor |
| 2,301,902 | A | 11/1942 | Merle |
| 3,206,808 | A | 9/1965 | Robinson |
| 3,752,212 | A | 8/1973 | Thompson |
| 4,210,193 | A | 7/1980 | Ruhle |
| 4,567,936 | A | 2/1986 | Binczewski |
| 4,585,047 | A | 4/1986 | Kawai et al. |
| 4,607,680 | A | 8/1986 | Mills et al. |
| 4,957,155 | A | 9/1990 | Trnka |
| 4,969,502 | A | 11/1990 | Mawer et al. |
| 5,020,583 | A | 6/1991 | Aghajanian et al. |
| 5,074,353 | A | 12/1991 | Ohno |
| 5,476,725 | A | 12/1995 | Papich et al. |
| 5,524,700 | A | 6/1996 | Gosch |
| 5,579,822 | A | 12/1996 | Darsy et al. |

(Continued)

FOREIGN PATENT DOCUMENTS

| | | |
|---|---|---|
| GB | 8490 | 0/1913 |
| JP | 56-77049 | 6/1981 |

(Continued)

OTHER PUBLICATIONS

European Search Report from European Patent Application No. 10 18 4881 dated Jan. 14, 2011.

(Continued)

*Primary Examiner* — Kevin P Kerns
(74) *Attorney, Agent, or Firm* — Greenberg Traurig, LLP

(57) ABSTRACT

Molten metal of a first composition flows out of a first chamber via an open first control apparatus into a mold cavity. The first control apparatus is closed. A second control apparatus is opened. Molten metal of a second composition, different from the first composition, flows out of a second feed chamber via the second control apparatus into the mold cavity. At least a portion of the first composition metal in the mold cavity is sufficiently molten that an initial feed of the second composition molten metal mixes with the first composition molten metal in the mold cavity. An ingot is removed from the mold cavity, the ingot having top, middle, and bottom sections, the bottom section composed of metal of the first composition, the top section composed of metal of the second composition, and the middle section composed of a mixture of metal of the first and second compositions.

2 Claims, 8 Drawing Sheets

U.S. PATENT DOCUMENTS

| | | | | |
|---|---|---|---|---|
| 6,298,898 | B1 | 10/2001 | Mahadeva et al. | |
| 6,495,269 | B1 | 12/2002 | Haszler et al. | |
| 6,705,384 | B2 | 3/2004 | Kilmer et al. | |
| 7,264,038 | B2 | 9/2007 | Chu et al. | |
| 7,377,304 | B2 | 5/2008 | Chu et al. | |
| 7,472,740 | B2 | 1/2009 | Anderson et al. | |
| 7,485,255 | B2 | 2/2009 | Chretien | |
| 7,516,637 | B2 | 4/2009 | Scamans et al. | |
| 7,516,775 | B2 | 4/2009 | Wagstaff et al. | |
| 7,547,463 | B2 | 6/2009 | Davisson et al. | |
| 7,617,864 | B2 | 11/2009 | Gallerneault | |
| 7,624,609 | B2 | 12/2009 | Ball et al. | |
| 7,648,674 | B2 | 1/2010 | Charpientier et al. | |
| 7,748,434 | B2 | 7/2010 | Wagstaff | |
| 7,762,310 | B2 | 7/2010 | Bull et al. | |
| 7,789,124 | B2 | 9/2010 | Gallerneault | |
| 7,789,254 | B2 | 9/2010 | Geho | |
| 7,789,978 | B2 | 9/2010 | Ward | |
| 7,819,170 | B2 | 10/2010 | Anderson et al. | |
| 7,823,623 | B2 | 11/2010 | Fitzsimon et al. | |
| 7,874,344 | B2 * | 1/2011 | Browne et al. | 164/94 |
| 7,951,468 | B2 | 5/2011 | Chu et al. | |
| 2003/0062143 | A1 | 4/2003 | Haszler et al. | |
| 2003/0165709 | A1 | 9/2003 | Gazapo et al. | |
| 2005/0011630 | A1 | 1/2005 | Anderson et al. | |
| 2005/0061129 | A1 * | 3/2005 | Berg et al. | 83/658 |
| 2006/0185816 | A1 | 8/2006 | Anderson et al. | |
| 2007/0012416 | A1 | 1/2007 | Chu et al. | |
| 2007/0012417 | A1 * | 1/2007 | Chu et al. | 164/122.1 |
| 2007/0106155 | A1 | 5/2007 | Goodnow et al. | |
| 2007/0193714 | A1 | 8/2007 | Barker et al. | |
| 2007/0209778 | A1 | 9/2007 | Gallerneault et al. | |
| 2007/0250000 | A1 | 10/2007 | Magnin et al. | |
| 2007/0259200 | A1 * | 11/2007 | Lequeu et al. | 428/577 |
| 2008/0000608 | A1 | 1/2008 | Chu et al. | |
| 2008/0029191 | A1 | 2/2008 | Simpson et al. | |
| 2008/0182122 | A1 | 7/2008 | Chu et al. | |
| 2008/0287801 | A1 | 11/2008 | Magnin et al. | |
| 2009/0007994 | A1 | 1/2009 | Zhao et al. | |
| 2009/0081072 | A1 | 3/2009 | Zhao et al. | |
| 2009/0145569 | A1 | 6/2009 | Anderson et al. | |
| 2010/0201155 | A1 | 8/2010 | Bassi et al. | |
| 2010/0297467 | A1 * | 11/2010 | Sawtell et al. | 428/610 |
| 2011/0100579 | A1 | 5/2011 | Chu et al. | |
| 2011/0252956 | A1 | 10/2011 | Sawtell et al. | |

FOREIGN PATENT DOCUMENTS

| | | | |
|---|---|---|---|
| JP | 57-85647 | | 5/1982 |
| JP | 58-32543 | | 2/1983 |
| JP | 58-32543 | A * | 2/1983 |
| JP | 61-169-138 | | 7/1986 |
| JP | 62-272569 | | 11/1987 |
| JP | 63-49357 | | 3/1988 |
| JP | 64-66061 | | 3/1989 |
| JP | 1 113 164 | | 5/1989 |
| JP | 2002-263799 | | 9/2002 |
| JP | 2003-145249 | | 5/2003 |
| JP | 2005-144482 | | 6/2005 |
| JP | 2005-144482 | A * | 6/2005 |
| WO | 02/18076 | | 3/2002 |

OTHER PUBLICATIONS

European Search Report from European Patent Application No. 10 15 8205 dated Jun. 30, 2010.

Office Action issued in connection with U.S. Appl. No. 12/982,980 mailed Jun. 14, 2011.

Office Action issued in connection with U.S. Appl. No. 12/982,980 mailed Feb. 25, 2011.

Office Action issued in connection with U.S. Appl. No. 12/059,620 mailed Oct. 15, 2010.

Office Action issued in connection with U.S. Appl. No. 12/059,620 mailed Apr. 22, 2010.

Office Action issued in connection with U.S. Appl. No. 12/059,620 mailed Jan. 6, 2010.

Official Action from the United States Patent and Trademark Office for U.S. Appl. No. 11/179,835 dated Oct. 12, 2006.

Official Action from the United States Patent and Trademark Office for U.S. Appl. No. 11/179,835 dated May 23, 2006.

Official Action from the United States Patent and Trademark Office for U.S. Appl. No. 11/484,276 dated May 31, 2007.

Official Action from the United States Patent and Trademark Office for U.S. Appl. No. 11/484,276 dated Apr. 9, 2007.

Official Action from the United States Patent and Trademark Office for U.S. Appl. No. 11/765,753 dated Dec. 28, 2007.

Official Action from the United States Patent and Trademark Office for U.S. Appl. No. 12/059,620 dated Apr. 29, 2009.

Official Action from the United States Patent and Trademark Office for U.S. Appl. No. 12/059,620 dated Nov. 20, 2008.

International Search Report form PCT/US2006/027348 dated May 30, 2007.

International Search Report from International Appln. No. PCT/US2010/035105 mailed Jul. 12, 2010.

Graham et al., "R&D for Industry: A Century of Technical Innovation at Alcoa", 1990. Cambridge University Press, pp. 251-262.

Yu et al., "Macrosegregation in Aluminum Alloy Ingot Cast by the Semicontinuous Direct Chill (DC) Method", Aluminum Alloys: Their Physical and Mechanical Properties, EMAS, UK, 1986, pp. 17-29.

Chu et al., "Macrosegregation Characteristics of Commercial Size Aluminum Alloy Ingot Cast by Direct Chill Method", Light Metals (1990), pp. 925-930.

Flemings et al., "Macrosegregation: Part I", Transactions of the Metallurigical Society of AIME, vol. 239 (1967), pp. 1449-1461.

Nadella et al., "Macrosegregation in direct-chill casting of aluminum alloys", Prog Mat Sci, vol. 53, pp. 421-480, 2008.

Chakrabarti et al., "Through Thickness Property Variations in 7050 Plate" Mat Sci Forum, vols. 217-222, pp. 1085-1090, 1996.

Vasudevan et al., "On Through Thickness Crystallographic Texture Gradient in Al-Li-Cu-Zr Alloy", Met. Trans. vol. 19A, pp. 731, 1988.

Brown, "Factors Influencing the Fracture Toughness of High Strength Aluminum Alloys", Strength of metals and alloys (ICSMA 6); Proceedings of the Sixth International Conference, Melbourne, Australia; United Kingdom; Aug. 16-20, 1982. pp. 765-771. 1983.

* cited by examiner

METHOD FOR PRODUCING INGOT WITH VARIABLE COMPOSITION USING PLANAR SOLIDIFICATION

CROSS REFERENCE TO RELATED APPLICATIONS

This application claims the benefit under 35 U.S.C. 119(e) of U.S. Provisional Application Ser. No. 61/055,081, filed May 21, 2008, which is incorporated in full herein by reference.

SUMMARY OF INVENTION

A method of casting metal, comprising the following steps. Molten metal of a first composition is fed into a mold cavity, via a first control apparatus, wherein the control apparatus is open, wherein the feeding comprises flowing out of a first feed chamber. The first control apparatus is closed. A second control apparatus is opened. Molten metal of a second composition is fed into the mold cavity, via the second control apparatus, wherein at least a portion of the metal of the first composition in the mold cavity is sufficiently molten so that an initial feed of molten metal of the second composition mixes with the molten metal of the first composition in the mold cavity, wherein the feeding comprises flowing out of a second feed chamber, wherein the second composition is different from the first composition. An ingot is removed from the mold cavity, wherein the ingot has a top section, a middle section, and a bottom section, wherein the bottom section is composed of metal of the first composition, wherein the top section is composed of metal of the second composition, wherein the middle section is composed of a mixture of metal of the first composition and the second composition.

A method of casting metal, comprising the following steps. Molten metal of a first composition is fed into a mold cavity, via a first control apparatus, wherein the control apparatus is open, wherein the feeding comprises flowing out of a first feed chamber. The first control apparatus is closed. A second control apparatus is opened. Any molten metal of the first composition between the first feed chamber and the first control apparatus is drained, Molten metal of a second composition is fed into the mold cavity, via the second control apparatus, wherein at least a portion of the metal of the first composition in the mold cavity is sufficiently molten so that an initial feed of molten metal of the second composition mixes with the molten metal of the first composition in the mold cavity, wherein the feeding comprises flowing out of a second feed chamber, wherein the second composition is different from the first composition. A first thickness of metal in the mold cavity is determined. The second control apparatus is closed in response to determining the first thickness. A second thickness of metal in the mold cavity is determined. The first control apparatus is opened in response to determining the second thickness. Molten metal of the first composition is fed into the mold cavity, wherein at least a portion of the metal of the second composition in the mold cavity is sufficiently molten so that an initial feed of molten metal of the first composition mixes with the molten metal of the second composition in the mold cavity. An ingot is removed from the mold cavity, wherein the ingot has a first layer, a second layer, a third layer, a fourth layer, and a fifth layer wherein the first and fifth layers are composed of metal of the first composition, wherein the third layer is composed of metal of the second composition, wherein the second and fourth layers are composed of a mixture of metal of the first composition and the second composition.

A cast metal ingot is formed, wherein a solidification front remains substantially planar during casting, wherein the ingot has a top section, a middle section, and a bottom section, wherein the bottom section is composed of metal of a first composition, wherein the top section is composed of metal of a second composition, wherein the middle section is composed of a mixture of metal of the first composition and the second composition.

A cast metal ingot is formed, wherein a solidification front remains substantially planar during casting, wherein the ingot has a first layer, a second layer, a third layer, a fourth layer, and a fifth layer wherein the first and fifth layers are composed of metal of a first composition, wherein the third layer is composed of metal of the second composition, wherein the second and fourth layers are composed of a mixture of metal of the first composition and the second composition.

A method of casting metal, comprising the following steps. A specified quantity of molten metal of a first composition is fed into a mixing apparatus. Molten metal is fed from the mixing apparatus into a mold cavity. A molten metal of a second composition is fed into the mixing apparatus, wherein the first composition is different from the second composition. An ingot is removed from the mold cavity, wherein the ingot has a thickness, a top, and a bottom, wherein the ingot composition includes a continuous gradient, wherein the continuous gradient is a gradient of metals of the first and second compositions, wherein an amount of metal of the first composition decreases gradually from the bottom of the ingot through the thickness to the top of the ingot, wherein an amount of metal of the second composition in increases gradually from the bottom of the ingot through the thickness to the top of the ingot.

A metal ingot is cast from at least two different metals, including a first composition and a second composition, wherein a solidification front remains substantially planar during casting, wherein the ingot has a thickness, a top, and a bottom, wherein the ingot composition includes a continuous gradient, wherein the continuous gradient is a gradient of metals of the first and second compositions, wherein an amount of metal of the second composition decreases gradually from the bottom of the ingot through the thickness to the top of the ingot, wherein an amount of metal of the first composition in increases gradually from the bottom of the ingot through the thickness to the top of the ingot.

A method of casting metal, comprising the following steps. Molten metal of a first composition is fed into a mold cavity via a first programmable control apparatus, wherein the feeding comprises flowing out of a first feed chamber. Molten metal of a second composition is fed into the mold cavity via a second programmable control apparatus, wherein the feeding comprises flowing out of a second feed chamber, wherein the second composition is different from the first composition. The first control apparatus is programmed to permit molten metal of the first composition to flow out of the first feed chamber at a desired rate that decreases to 0 lbs/minute during a desired first casting period. The second control apparatus is programmed to permit molten metal of the second composition to flow out of the second feed chamber at a rate increasing from 0 lbs/minute to the desired rate. The first control apparatus is also programmed to permit molten metal to flow out of the first feed chamber at a rate increasing from 0 lbs/minute to the desired rate, during a desired second casting period. The second control apparatus is also programmed to permit molten metal to flow out of the second feed chamber at a rate decreasing from the desired rate to 0 lbs/minute during the second casting period. An ingot is removed from the mold cavity, wherein the ingot has a thickness, a top, a bottom, and a mid-point, wherein the ingot composition includes a continuous gradient, wherein the continuous gradient is a gradient of metals of the first and second composition, wherein an amount of metal of the first composition decreases gradually from the bottom of the ingot through the thickness to the mid-point of the ingot, wherein an amount of metal of the first composition increases gradually from the mid-point of the ingot through the thickness to the top of the ingot.

A metal ingot is cast from at least two different metals, including a first composition and a second composition, wherein a solidification front remains substantially planar during casting, wherein the ingot has a thickness, a top, a bottom, and a mid-point, wherein the ingot composition includes a continuous gradient, wherein the continuous gradient is a gradient of metals of the first and the second composition, wherein an amount of metal of the first composition decreases gradually from the bottom of the ingot through the thickness to the mid-point of the ingot, wherein an amount of metal of the first composition increases gradually from the mid-point of the ingot through the thickness to the top of the ingot.

DETAILED DESCRIPTION

Figure 1:
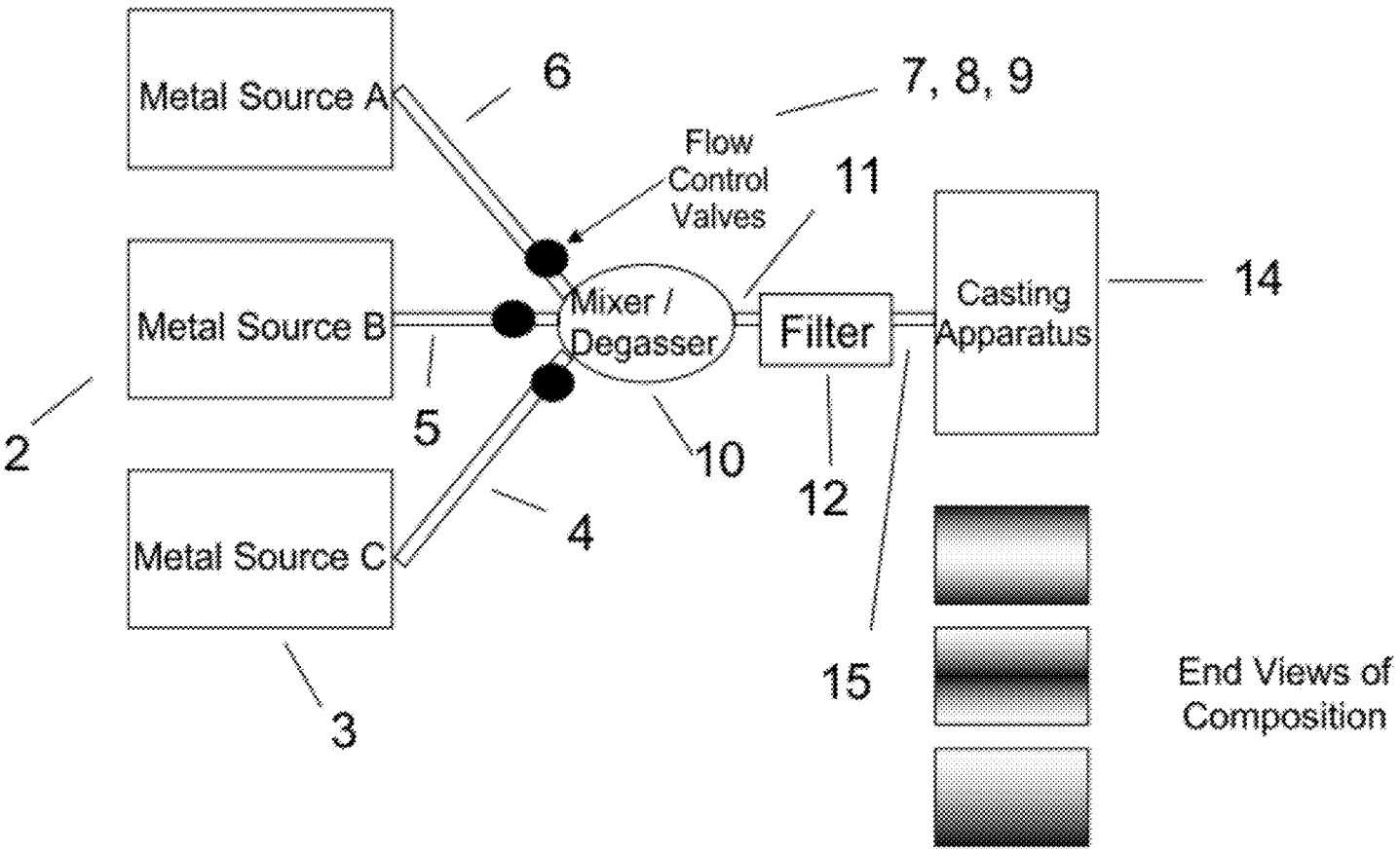
FIG. 1 is a top view of an illustration of one embodiment of the casting system of the present invention.

In one embodiment of the present invention, a cast ingot is formed by a method of unidirectional solidification wherein the composition is varied through the thickness, either gradually or in steps or any combination of the two. For purposes of this description, thickness is defined as the thinnest dimension of the casting. A casting system used to produce the ingot includes, in one embodiment, a casting apparatus including a mold cavity oriented substantially horizontally, having a plurality of sides and a bottom that may be structured to selectively permit or resist the effects of a coolant sprayed thereon. One example of a bottom configuration is a substrate having holes of a size that allow coolants to enter but resist the exit of molten metal. Such holes are, in one example, at least about 1/64 inch in diameter, but not more than about one inch in diameter. Another example of a bottom configuration is a conveyor having a solid section and a mesh section. One example of a casting apparatus that may be used is described in U.S. Pat. Nos. 7,377,304 and 7,264,038. By this reference, the contents of these patents are deemed to be incorporated into the present application.

In one embodiment of the casting system, a trough for transporting material from each of at least two reservoirs leads to a mixer or a standard degassing unit, each trough having a flow control valve to vary the flow of material from the reservoir into a mixer or standard degassing unit. In one example, at least one trough leads from the mixer to a degassing unit and a filter, from which the trough terminates at a side of the mold cavity, and is structured to introduce material to the mold cavity in a level fashion. In another embodiment, the material is delivered vertically to the top of the mold cavity in a controlled manner. In either of these embodiments, the material may be delivered at a single point or multiple points around the mold cavity.

The sides of the mold cavity are in one embodiment insulated. A plurality of cooling jets, for example air/water jets, are located below the bottom, and are structured to spray coolant against the bottom surface of the substrate. In one embodiment, the substrate is perforated allowing the cooling media to directly contact the solidifying ingot.

In one embodiment, molten metal is introduced substantially uniformly through the mold cavity. At the same time, for example, a cooling medium is applied uniformly over the bottom side of the substrate. In another embodiment, the rate at which molten metal flows into the mold cavity, and the rate at which coolant is applied to the bottom are both controlled to provide unidirectional solidification. The coolant may begin as air, for example, and then gradually be changed from air to an air-water mist, and then to water but any cooling media or delivery method that achieves the desired heat transfer can be used.

Accordingly, one embodiment of the present invention provides an improved method of directionally solidifying castings during cooling where the solidification front remains substantially planar. Hence, in one example, as composition of the metal fed into the mold cavity varies, the composition of the resultant ingot varies in a consistent way through the thickness. In this example, the composition varies through the thickness but not across the width or length of the ingot.

In one embodiment, by varying the flow of material from each reservoir, the composition of the ingot can be varied gradually or in a layered manner. The following examples result in an ingot having layers of different compositions, with an interface between the layers that is relatively sharp, compared to the next group of examples. In one example, material of a first composition flows out of the first reservoir and then is halted at the same time that the flow of material having a second composition is initiated from the second reservoir. In this example the resultant ingot consists of a layer of the first composition combined with a layer of the second composition.

In another example, molten metal of the first composition flows from a first reservoir into a first degasser or other means for removing hydrogen or other undesirable elements from the molten metal, including, for example, sodium, potassium, or calcium. The degasser can be located in the casting line, such as a porous trough degasser or a compact degasser. Alternatively, the degasser can treat the molten metal outside of the casting line and the molten metal is transferred back into the casting line.

In a further example molten metal of the first composition next flows from the degasser into a filter, such as for example a ceramic foam filter or other means for removing nonmetallic inclusions, for example oxides.

In another example, molten metal of the first composition flows into the mold cavity through a trough including a first control apparatus or similar device that regulates the flow rate of the molten metal. The control apparatus may be, for example, a pneumatic gate or dam, and is computer-controlled and/or programmable. In another example, the trough leading to the mold cavity contains a second control apparatus or similar device, through which molten metal of the second composition flows into the mold cavity.

In another example, flow from each reservoir is alternated repeatedly and in any pattern desired, resulting in a multi-layered ingot. The flows are started and stopped by opening and closing the first and second control apparatuses as needed. The control apparatuses may be opened and closed, for example, by computer-controlled pneumatics. In yet another example, flow from each reservoir is varied, resulting in a variable composition in a first increment of thickness and then flow is stopped from one of the reservoirs to produce a layer of constant composition in the next increment of thickness. In a further example, molten metal of the first composition is drained from any trough between the first feed chamber and the first control apparatus before the second control apparatus is opened to permit the flow of molten metal of the second composition into the mold cavity. In another example, molten metal of the second composition is drained from any trough between the second feed chamber and the second control apparatus before the first control apparatus is re-opened, re-feeding molten metal of the first composition into the mold cavity.

Suitable alloy compositions include, but are not limited to, alloys of the AA series 1000,2000, 3000, 4000, 5000, 6000, 7000, or 8000. Other suitable metals may include magnesium base alloys, iron base alloys, titanium base alloys, nickel base alloys, and copper base alloys.

In one example, the first composition is a 5456 alloy. About 5000 lbs of the first composition is held in a furnace at about 1370° Fahrenheit. The second composition is a 7085 alloy. About 6000 lbs of the second composition is held in a furnace at about 1370° Fahrenheit. The molten metal of the first composition flows from the first furnace-reservoir to the first degasser at a rate of about 80 lbs/minute. The degasser rotates at a constant speed as molten metal is transferred out of the furnace-reservoir. The molten metal of the second composition flows from the second furnace-reservoir to the second degasser, and the second filter, then stops at the closed second control apparatus. After a thickness of about 6 inches of metal of the first composition is in the mold cavity, the first control apparatus is closed. After a thickness of about 7 inches of metal of the first composition is in the mold cavity, the flow of molten metal out of the first furnace-reservoir is stopped. The flow out of a feed chamber such as a furnace-reservoir may be stopped, for example, by using a refractory-type plug or similar device to plug the opening in the feed chamber through which the molten metal is flowing. Alternatively, the flow out of a feed chamber such as a tilt furnace may be stopped, for example, by tilting the reservoir. The molten metal of the first composition that has flowed out of the first furnace-reservoir but did not flow into the mold cavity is drained out, and the first filter replaced. Next, the second control apparatus is opened, and molten metal of the second composition flows into the mold cavity at a rate of about 80 lbs/minute. Just before the thickness of metal in the mold box reaches about 15 inches, the second control apparatus is closed, and the flow of molten metal out of the second furnace-reservoir is stopped. Concomitant with closing the second control apparatus and stopping the flow out of the second furnace-reservoir, the first furnace-reservoir is re-opened and molten metal of the first composition flows to the first degasser, then through the first filter that is replaced, then stops at the closed first control apparatus. When the thickness of the metal in the mold box reaches about 15 inches, the first control apparatus is opened and molten metal of the first composition flows into the mold cavity. Casting continues until a thickness of about 18 inches of metal is in the mold cavity. The resulting ingot has a composition of a continuous gradient between metal of the first and second compositions.

The following examples result in an ingot having layers of different compositions, with an interface between the layers that is relatively diffuse, compared to the preceding group of examples. In one example, material is fed from both reservoirs, simultaneously, resulting in a composition that is a mix of the compositions in each reservoir related to the material flow rates from each reservoir. In another example, the flow from each reservoir is varied continuously to create any desired mixture at any given position through the thickness of the solidified ingot. In yet another example, flow from each reservoir is varied resulting in a variable composition in a first increment of thickness and then flow is stopped from one of the reservoirs to produce a layer of constant composition in the next increment of thickness. Such a procedure could be varied, in other examples, in any way desired to produce alternating layers of gradient compositions, constant compositions or any combination, therein.

Another embodiment of the invention provides a method of maintaining a relatively constant solidification rate through the thickness of the casting by varying application of the cooling media.

In one example, molten metal of a first composition is an aluminum alloy that is 6 weight percent magnesium. About 6000 lbs of molten metal of the first composition is in a furnace-reservoir at about 1370° Fahrenheit. Molten metal of the second composition is an aluminum alloy that is 2.5 weight percent magnesium. About 700 lbs of molten metal of the second composition is in a mixing apparatus at about 1350° Fahrenheit. The furnace-reservoir is opened, permitting molten metal of the first composition to flow into the mixing apparatus at a rate of about 80 lbs/minute. Molten metal flows out of the mixing apparatus into a filter, and into the mold cavity. Casting continues with molten metal flowing from the furnace-reservoir into the mixing apparatus, from the mixing apparatus into the filter, and from the filter into the mold cavity until metal in the mold cavity reaches a thickness of about 22 inches. The resulting ingot has a single composition gradient through the thickness, for example the magnesium content. In another example, the mixing apparatus is a degasser that rotates at a constant speed.

In another example, molten metal of a first composition is an aluminum alloy that is 2 weight percent magnesium. About 5000 lbs of molten metal of the first composition is in a first furnace-reservoir at about 1370° Fahrenheit. Molten metal of a second composition is an aluminum alloy that is 5 weight percent magnesium. About 5000 lbs of molten metal of the second composition is in a second furnace-reservoir at about 1370° Fahrenheit. A first programmable control apparatus between the first furnace-reservoir and a degasser located in the casting line is programmed to permit molten metal of the first composition to flow out of the first furnace-reservoir into the degasser at a rate decreasing from, for example, 80 lbs/minute to 0 lbs/minute during a first casting period, for example 16 minutes. The first casting period is determined by determining a first desired thickness of metal to flow into the mold cavity, for example 8 inches. The rate may decrease, for example, linearly, exponentially, or parabolically. The first control apparatus is also programmed to permit molten metal of the first composition to flow out of the first furnace-reservoir into the degasser at a rate increasing from 0 lbs/minute to the original rate at which molten metal of the first composition flowed out of the first furnace-reservoir, for example 80 lbs/minute, during a second casting period, for example, 16 minutes. The second casting period is determined by determining a second desired thickness of metal to flow into the mold cavity, for example 8 inches. The rate may increase, for example, linearly, exponentially, or parabolically. The second control apparatus is programmed to permit molten metal of the second composition to flow out of the second furnace-reservoir into the degasser at a rate increasing from 0 lbs/minute to, for example, the maximum rate at which molten metal of the first composition is permitted to flow, for example 80 lbs/minute, during the first casting period. The rate may increase, for example, linearly, exponentially, or parabolically. The second control apparatus is also programmed to permit molten metal of the second composition to flow out of the second furnace-reservoir into the degasser at a rate decreasing from the maximum rate attained, for example 80 lbs/minute, to 0 lbs/minute during the second casting period. The rate may decrease, for example, linearly, exponentially, or parabolically. When casting begins, the control apparatuses function as programmed, and molten metal flows out of the furnace-reservoirs, into a degasser, into a filter, and into the mold cavity. Casting continues until the metal in the mold cavity reaches a total desired thickness, for example 16 inches. The resulting ingot has a continuous gradient composition across the thickness, for example the magnesium content.

In one embodiment of the present invention, the casting apparatus comprising a plurality of sides and a bottom defining a mold cavity, wherein the bottom has at least two surfaces, including a first surface and a second surface. The casting system further includes at least two metal feed chambers, including a first and a second feed chamber, each feed chamber adjacent to a different degasser, each degasser adjacent to a different filter. The casting system also includes at least one trough into which each filter leads, that is adjacent to the mold cavity, wherein the trough includes at least one control apparatus between each filter and the mold cavity, the control apparatuses being structured to control the flow rates of molten metal being fed into the mold cavity. In this embodiment, the bottom of the mold cavity comprises a substrate having (a) sufficient dimensions, and (b) a plurality of apertures, such that the bottom: (i) allows cooling mediums to flow through the apertures and directly contact the metal, wherein a direction of the flow of the cooling medium is from the first surface of the bottom into the mold cavity, and (ii) simultaneously resists the metal initially poured directly onto the second surface of the bottom from exiting through the apertures to the first surface of the bottom. Each feed chamber contains molten metal of different compositions. Molten metal from the first feed chamber is fed into a first degasser adjacent the first feed chamber. The molten metal from the first degasser is fed to a first filter adjacent the first degasser. The molten metal from the first filter is fed into the mold cavity through the trough, wherein the control apparatus between the first filter and the mold cavity is open. Before a desired thickness is reached in the mold cavity, molten metal from the second feed chamber is fed into a second degasser adjacent the second feed chamber. The molten metal from the second degasser is fed to a second filter adjacent the second degasser. The molten metal from the second filter is fed into the trough, wherein the control apparatus between the second filter and the mold cavity is closed. The control apparatus in the trough between the first filter and the mold cavity is then closed. The flow of molten metal out of the first feed chamber into the first degasser is halted. Any metal between the feed chamber and the first control apparatus is drained. The control apparatus in the trough between the second filter and the mold cavity is opened thereby feeding the molten metal from the second filter into the mold cavity. Before a desired thickness is reached in the mold cavity, the control apparatus in the trough between the second filter and the mold cavity is closed. The flow of molten metal out of the second feed chamber into the second degasser is halted, and the control apparatus in the trough between the second filter and the mold cavity is closed. Any metal between the feed chamber and the second control apparatus is drained. Molten metal from the first feed chamber is re-fed into the first degasser, and flows from the first degasser into an renewed first filter, and from the first filter into the trough. After a desired thickness is reached in the mold cavity, the control apparatus between the renewed first filter and the mold cavity is opened, thereby re-feeding molten metal from the renewed first filter into the mold cavity. Simultaneously a cooling medium is directed against the bottom of the mold cavity, whereby the molten metal is cooled unidirectionally through its thickness.

In another embodiment of the present invention the casting apparatus comprises a plurality of sides and a bottom defining a mold cavity, wherein the bottom has at least two surfaces, including a first surface and a second surface. The casting system further comprises at least one metal feed chamber adjacent to a mixing apparatus and at least one control apparatus between the feed chamber and the mixing apparatus, the control apparatus being structured to control the flow rates of molten metal being fed into the mixing apparatus. The casting system also includes at least one filter between the mixing apparatus and the mold cavity and at least one control apparatus between the filter and the mold cavity, the control apparatus being structured to control the flow rates of molten metal being fed into the mold cavity. The bottom of the mold cavity comprises a substrate having (a) sufficient dimensions, and (b) a plurality of apertures, such that the bottom: (i) allows cooling mediums to flow through the apertures and directly contact the metal, wherein a direction of the flow of the cooling medium is from the first surface of the bottom into the mold cavity, and (ii) simultaneously resists the metal initially poured directly onto the second surface of the bottom from exiting through the apertures to the first surface of the bottom. The feed chamber and mixing apparatus each contain molten metal of different compositions. Molten metal is fed from the feed chamber to the mixing apparatus. Molten metal is fed from the mixing apparatus into the filter. Molten metal is fed from the filter into the mold cavity. Simultaneously a cooling medium is directed against the bottom of the mold cavity, whereby the molten metal is cooled unidirectionally through its thickness. In another embodiment, the mixing apparatus is a degasser that rotates at a constant speed. In yet another embodiment, the casting system includes a degasser between the mixing apparatus and the filter.

In yet another embodiment of the present invention, the casting apparatus comprises a plurality of sides and a bottom defining a mold cavity, wherein the bottom has at least two surfaces, including a first surface and a second surface. The casting system further comprises at least two metal feed chambers, including a first and a second feed chamber and at least one trough into which each feed chamber leads, wherein the trough includes at least one programmable control apparatus between each feed chamber and a degasser located in the casting line, the control apparatuses being structured to control the flow rates of molten metal being fed into the degasser. The casting system also includes at least one filter between the degasser and the mold cavity The bottom of the mold cavity comprises a substrate having (a) sufficient dimensions, and (b) a plurality of apertures, such that the bottom: (i) allows cooling mediums to flow through the apertures and directly contact the metal, wherein a direction of the flow of the cooling medium is from the first surface of the bottom into the mold cavity, and (ii) simultaneously resists the metal initially poured directly onto the second surface of the bottom from exiting through the apertures to the first surface of the bottom. The feed chambers each contain molten metal of different composition. A first control apparatus between the first feed chamber and the degasser is programmed to permit molten metal to flow into the degasser at a rate decreasing linearly from a desired flow rate to 0 lbs/minute during a desired first casting period. A second control apparatus is programmed between the second feed chamber and the degasser to permit molten metal to flow into the degasser at a rate increasing linearly from 0 lbs/minute to the same rate at which molten metal began flowing into the degasser from the first feed chamber during the first casting period. The first control apparatus is also programmed to permit molten metal to flow into the degasser at a rate increasing linearly from 0 lbs/minute to the rate at which molten metal began flowing into the degasser during the first casting period, during a desired second casting period. The second control apparatus is also programmed to permit molten metal to flow into the degasser from the second feed chamber at a rate decreasing linearly to 0 lbs/minute from the rate at which molten metal began flowing into the degasser from the first feed chamber during the first casting period, during the second casting period. Molten metal is fed from the feed chambers into the degasser through the trough, wherein the control apparatuses control the flow as programmed. Simultaneously a cooling medium is directed against the bottom of the mold cavity, whereby the molten metal is cooled unidirectionally through its thickness.

FIG. 1 is an illustration of one embodiment of the casting system of the present invention. In this embodiment, the casting system is a device for casting metal alloy products comprising: a system having at least one source of material (1, 2, 3), each source having a feed trough (4, 5, 6) leading to a mixer/degasser (10); a flow control valve (7, 8, 9) between each feed trough (4, 5, 6) and the mixer/degasser (10), wherein the flow control valves (7, 8, 9) vary flows of material into the mixer/degasser (10); another feed trough (11) leading from the mixer/degasser to a filter (12); a final feed trough leading from the filter to the casting apparatus (14).

In a further embodiment, the sources of material (1, 2, 3) are furnace-reservoirs.

Figure 2:
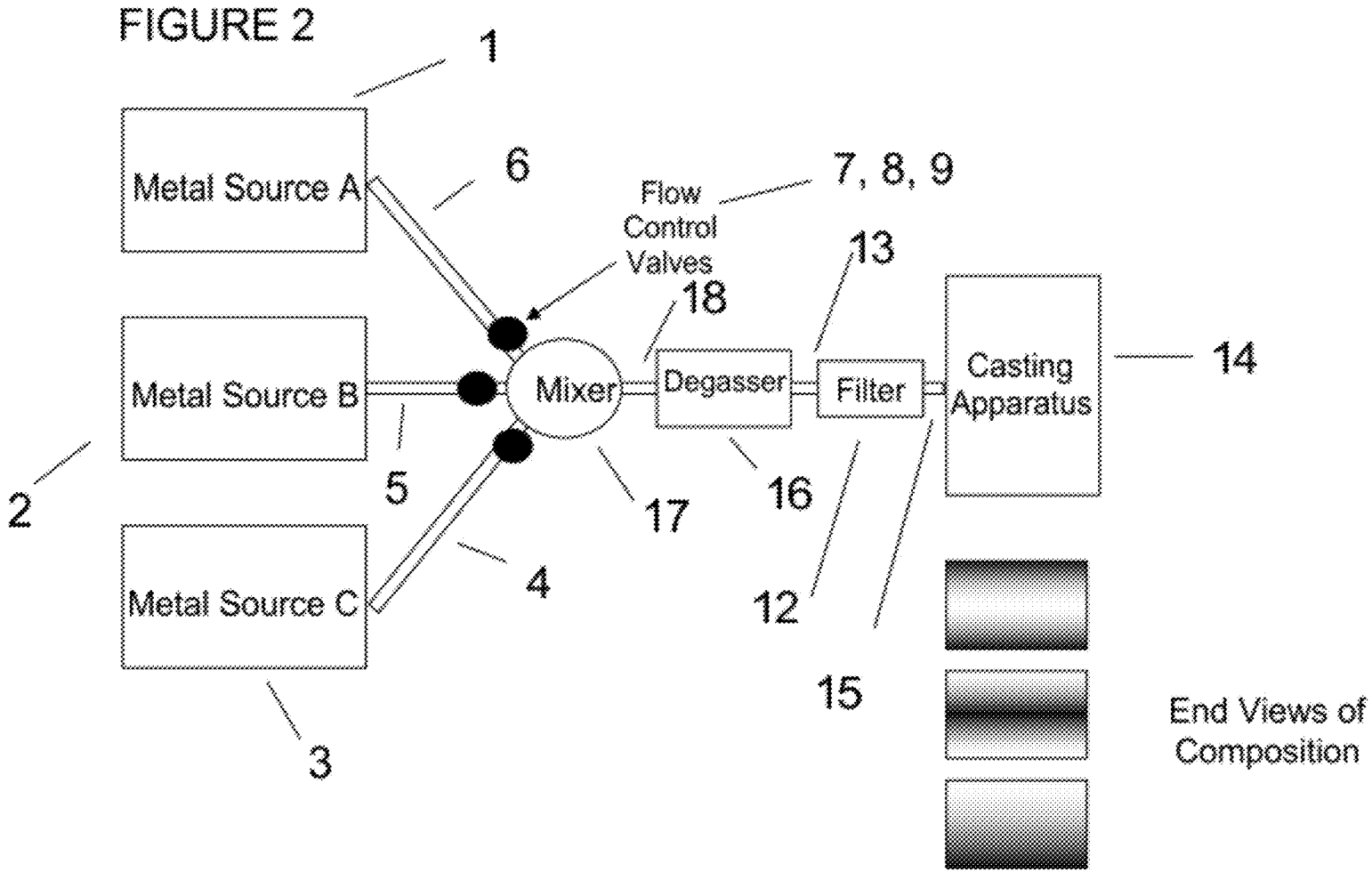
FIG. 2 is a top view of an illustration of another embodiment of the casting system of the present invention.

FIG. 2 is an illustration of another embodiment of the casting system of the present invention. In this embodiment, each feed trough (4, 5, 6) leads to a mixer (17); a flow control valve (7, 8, 9) is between each feed trough (4, 5, 6) and the mixer (10); another feed trough (18) leads from the mixer (17) to a degasser (16); yet another feed trough (13) leads from the degasser (16) to a filter (12); finally a feed trough (15) leading from the filter to the casting apparatus (14).

Although the embodiments described in FIGS. 1 and 2 contain three independent material sources or furnace-reservoirs, any number of independent reservoirs could be used in any configuration needed to achieved the desired variations in ingot composition.

Figure 2A:
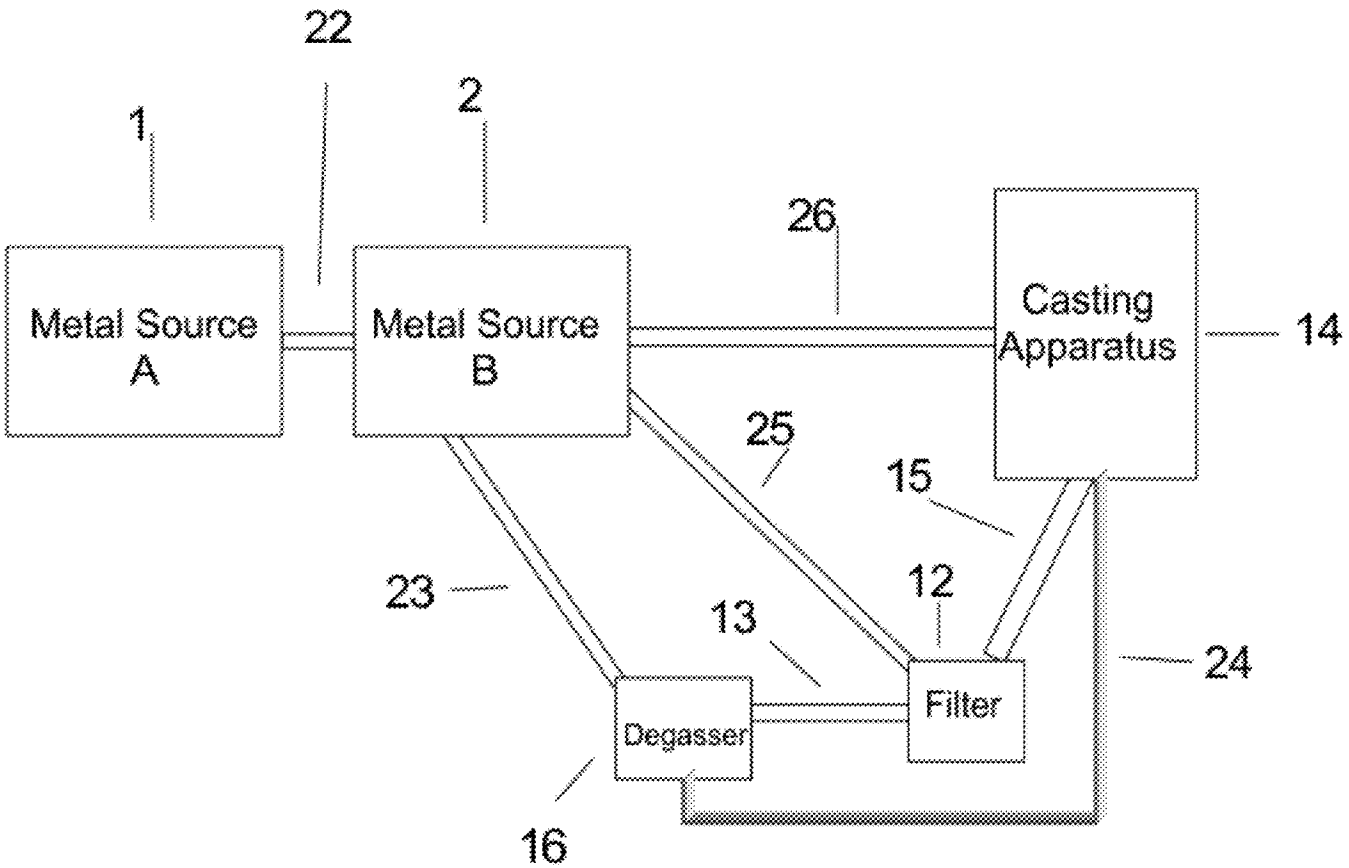
FIG. 2*a* is a top view of an illustration of a further embodiment of the casting system of the present invention.

FIG. 2*a* is an illustration of an embodiment of the casting system of the present invention. In this embodiment, the composition of the ingot formed by the system is varied by flowing material from the first metal source (1) through a trough (22) into another metal source (2), and then through a trough (26) to the casting apparatus (14). The material may optionally flow from the second metal source (2) through a trough (23) to a degasser (16), then through a trough (24) to the casting apparatus (14); the material may flow from the degasser (16) through a trough (13) to a filter (12) and then to the casting apparatus (14) through a trough (15); the material may also flow from the second metal source (2) through a trough (25) to the filter (12) and then to the casting apparatus (14) through trough (15).

Figure 3:
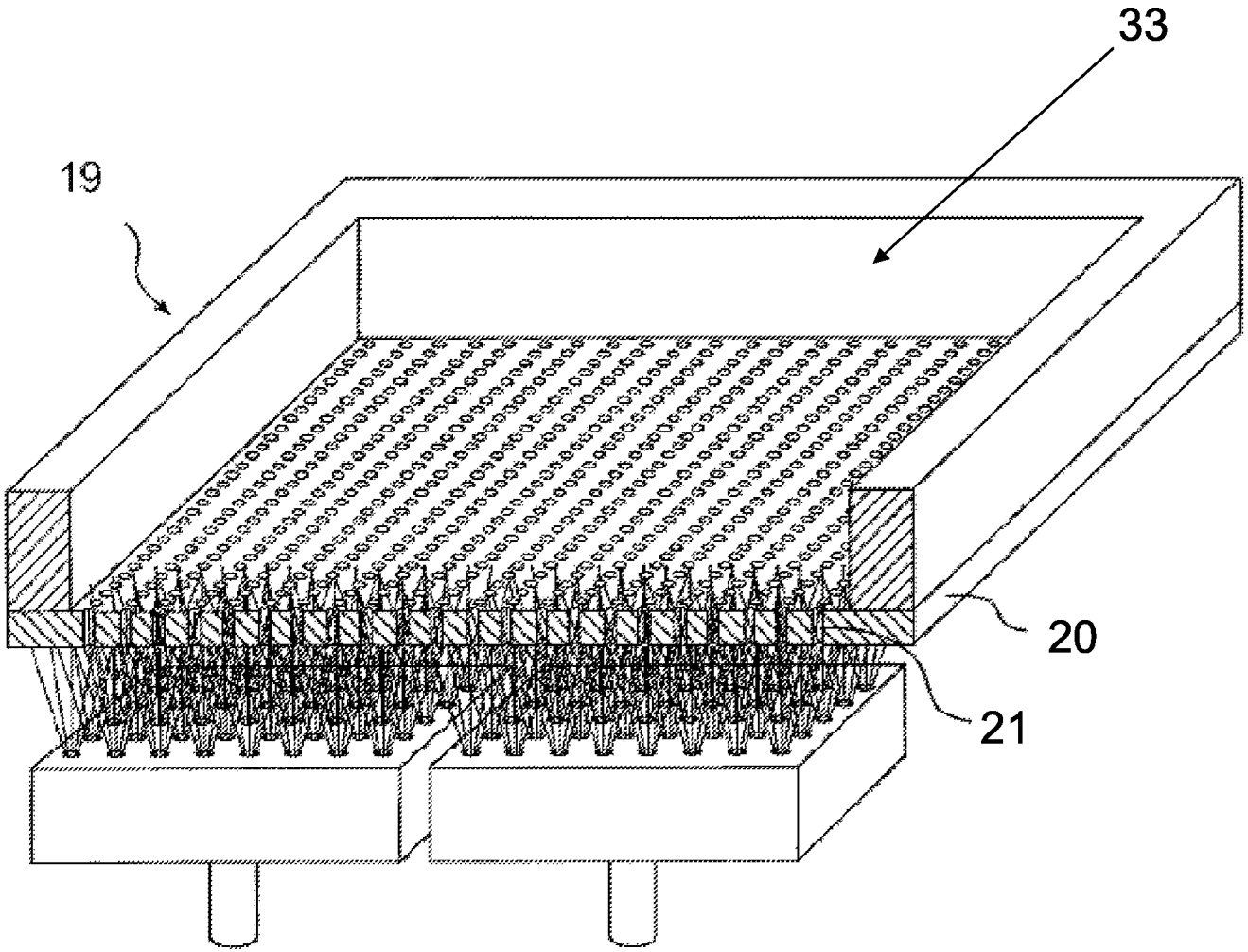
FIG. 3 is a cutaway front view of an illustration of an example of the casting apparatus including the mold cavity of an embodiment of the casting system of the present invention.

FIG. 3 is an illustration of an embodiment of the casting apparatus of the present invention. In this embodiment, the casting apparatus (19) has a plurality of sides and a bottom (20) defining a mold cavity, wherein the bottom has at least two surfaces, including a first surface and a second surface; at least one control apparatus between the source of material and the mold cavity, the control apparatus being structured to control the flow rates of molten metal being fed into the mold cavity, wherein the bottom comprises a substrate having (a) sufficient dimensions, and (b) a plurality of apertures (21), such that the bottom (20): (i) allows cooling mediums to flow through the apertures and directly contact the metal, wherein a direction of the flow of the cooling medium is from the first surface of the bottom into the mold cavity, and (ii) simultaneously resists the metal initially poured directly onto the second surface of the bottom from exiting through the apertures to the first surface of the bottom. A preferred diameter for the apertures 21 is about 1/64 inch to about one inch.

A coolant manifold is disposed below the bottom (20) in one embodiment. The coolant manifold preferably is configured to selectively spray air, water, or a mixture of air and water against the bottom (20).

In a further embodiment, a laser sensor may be disposed above the mold cavity, and is preferably structured to monitor the level of material within the mold cavity.

The application of coolant to the bottom of the mold cavity, along with, in some preferred embodiments, the insulation on the sides results in directional solidification of the casting from the bottom to the top of the mold cavity. Preferably, the rate of introduction of material into the mold cavity, combined with the cooling rate, will be controlled to maintain about 0.1 inch (2.54 mm.) to about 1 inch (25.4 mm) of material within the mold cavity 33 at any given time. In some embodiments, the mushy zone between the molten metal and solidified metal may also be kept at a substantially uniform thickness.

Figure 4:
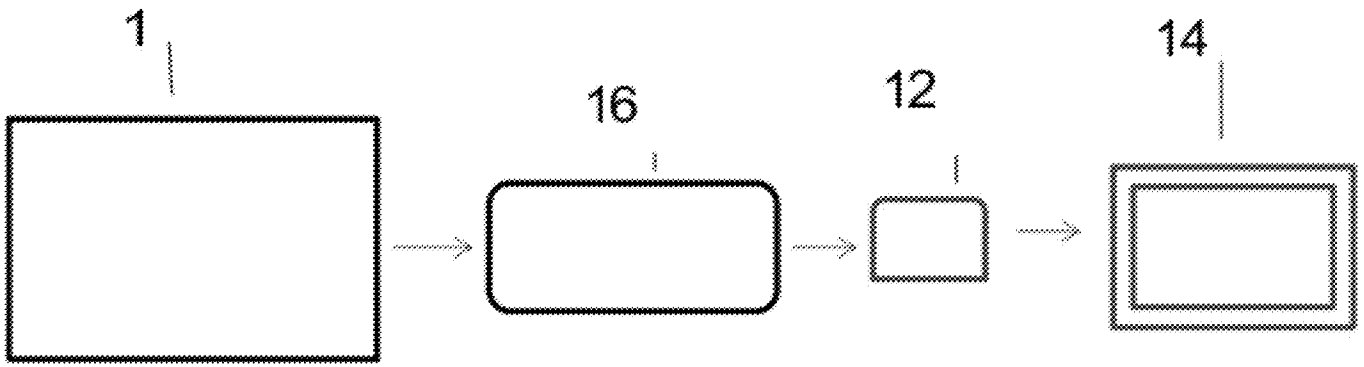
FIG. 4 is a top view of an illustration of one embodiment of the casting system of the present invention.

FIG. 4 is an illustration of one embodiment of the casting system of the present invention. In this embodiment, the casting system is a device for casting metal alloy products comprising: a system having at least one source of material (1); the source leading to a degasser (16); the degasser leading to a filter (12); and the filter leading to the casting apparatus (14). In this embodiment, the resulting ingot has a composition of a continuous gradient between metal of a first composition originating in the metal source, and metal of a second composition originating in the degasser.

In a further embodiment, the metal source (1), degasser (16), filter (12), and casting apparatus (14) are connected by feed troughs.

In yet another embodiment, the metal source (1) is a furnace-reservoir.

Figure 5:
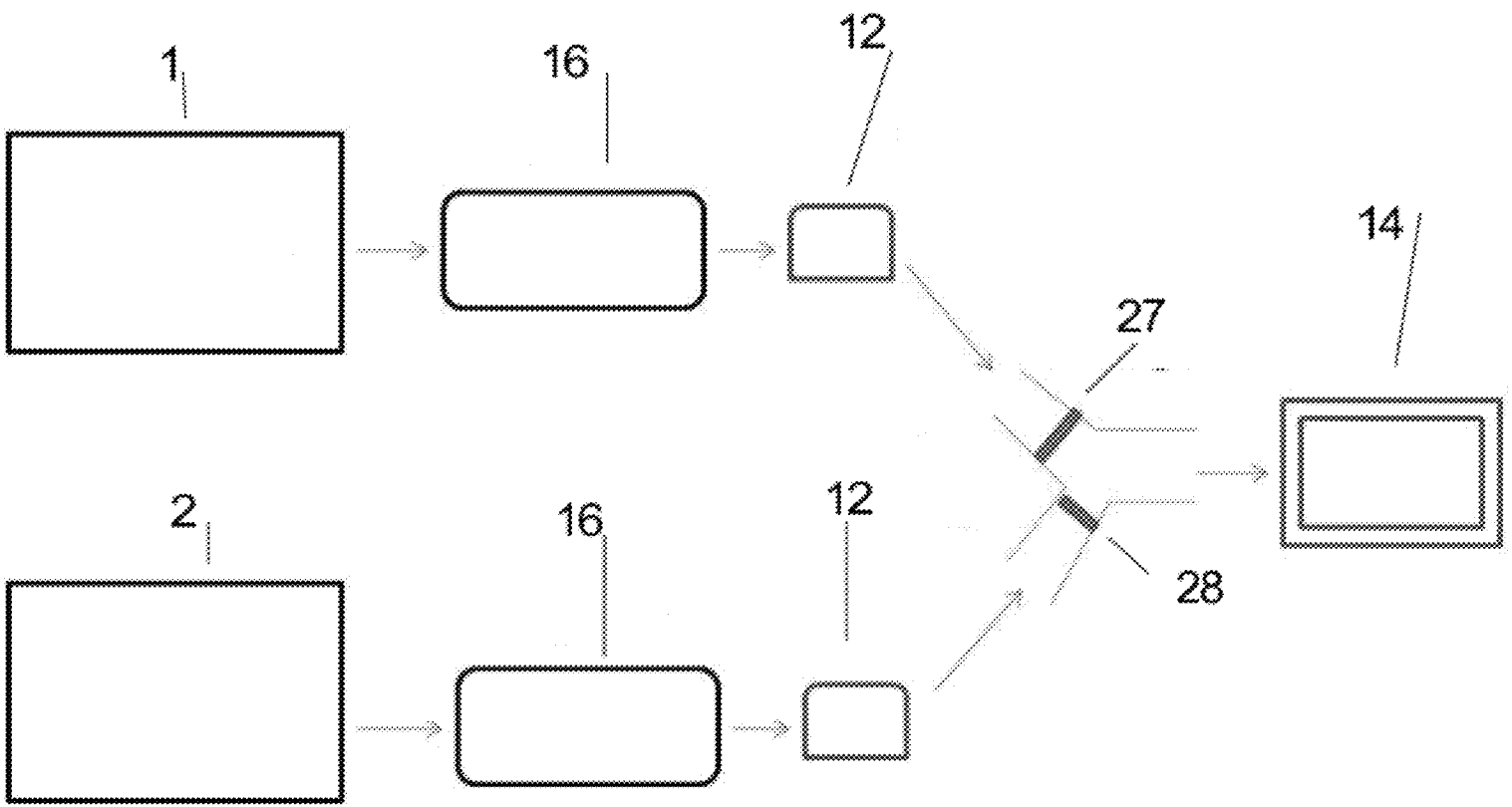
FIG. 5 is a top view of an illustration of another embodiment of the casting system of the present invention

FIG. 5 an illustration of one embodiment of the casting system of the present invention. In this embodiment, the casting system is a device for casting metal alloy products comprising: a system having at least two sources of metal (1, 2); the sources each leading to degassers (16); the degassers each leading to filters (12); the filter leading to a trough having two control apparatuses (27, 28); the trough leading beyond the control apparatuses (27, 28) to the casting apparatus (14). In this embodiment, the resulting ingot contains two different metals, each originating in one of the metal sources, and has a single composition gradient through the thickness.

In a further embodiment, the metal sources (1, 2), degassers (16), filters (12), and casting apparatus (14) are connected by feed troughs.

In yet another embodiment, the metal sources (1, 2) are furnace-reservoirs.

Figure 6:
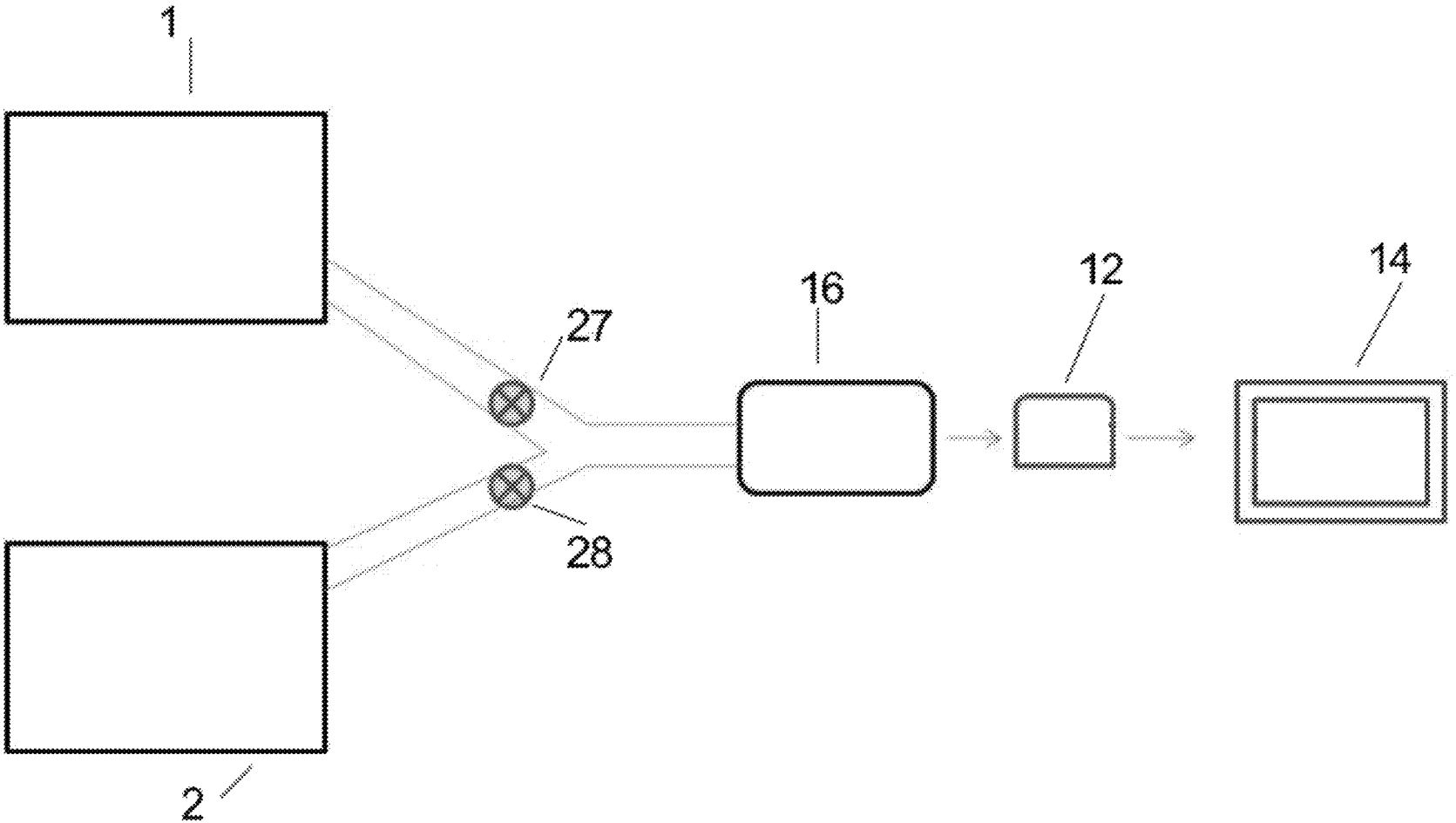
FIG. 6 is a top view of an illustration of a further embodiment of the casting system of the present invention.

FIG. 6 an illustration of one embodiment of the casting system of the present invention. In this embodiment, the casting system is a device for casting metal alloy products comprising: a system having at least two sources of metal (1, 2); the sources leading to a trough having two control apparatuses (27, 28); the control apparatuses leading to a degasser (16); the degasser leading to a filter (12); the filter leading to the casting apparatus (14). In this embodiment, the resulting ingot contains two different metals, each originating in one of the metal sources, and has a continuous gradient composition across the thickness, for example the magnesium content.

In a further embodiment, the metal sources (1, 2), degasser (16), filter (12), and casting apparatus (14) are connected by feed troughs.

In yet another embodiment, the metal sources (1, 2) are furnace-reservoirs.

Although the embodiments described in FIGS. 5 and 6 contains two independent material sources or furnace-reservoirs, any number of independent reservoirs could be used in any configuration needed to achieved the desired variations in ingot composition.

Figure 7:
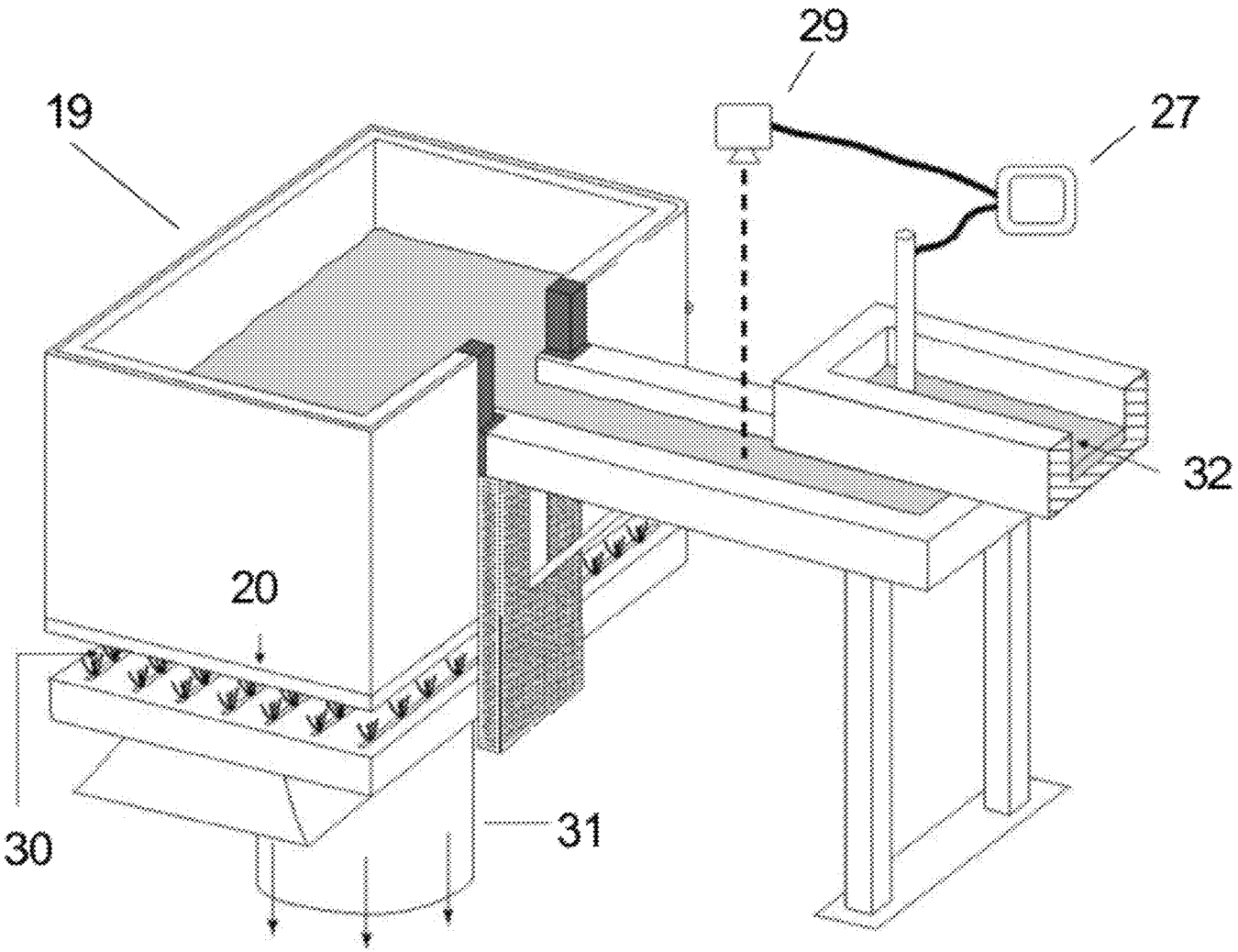
FIG. 7 is a cutaway perspective view of an illustration of an embodiment of the casting system including the mold cavity of an embodiment of the present invention.

FIG. 7 is an illustration of an embodiment of the casting system of the present invention. In this embodiment, the casting system is a device for casting metal alloy products comprising: a system including a casting apparatus (19) having a plurality of sides and a bottom (20) defining a mold cavity, wherein the bottom has at least two surfaces, including a first surface and a second surface; at least one control apparatus (27) between the source of material and the mold cavity, the control apparatus being structured to control the flow rates of molten metal (32) being fed into the mold cavity, wherein the bottom comprises a substrate having (a) sufficient dimensions, and (b) a plurality of apertures, such that the bottom (20): (i) allows cooling mediums (30) to flow through the apertures and directly contact the metal, wherein a direction of the flow of the cooling medium (30) is from the first surface of the bottom into the mold cavity, and (ii) simultaneously resists the metal initially poured onto the second surface of the bottom from exiting through the apertures to the first surface of the bottom (20). The casting apparatus (19) and coolant manifold are positioned on a support (31) that is moveable in the vertical direction. In this embodiment, a laser sensor (29) is disposed above the casting system, and is preferably structured to monitor the level of material within the mold cavity.

What is claimed:

1. A method of casting metal, comprising the following steps:

feeding molten metal of a first composition into a mold cavity, via a first control apparatus, wherein the molten metal of the first composition is an aluminum alloy, wherein the control apparatus is open, wherein the feeding comprises flowing out of a first feed chamber;

closing the first control apparatus;

opening a second control apparatus;

feeding molten metal of a second composition into the mold cavity, via the second control apparatus, wherein the molten metal of the second composition is an aluminum alloy, wherein at least a portion of the metal of the first composition in the mold cavity is sufficiently molten so that an initial feed of molten metal of the second composition mixes with the molten metal of the first composition in the mold cavity, wherein the feeding comprises flowing out of a second feed chamber, wherein the second composition is different from the first composition; and removing an ingot from the mold cavity after the molten metal solidifies, wherein the solidification front remained substantially planar, wherein the ingot has a top section, a middle section, and a bottom section, wherein the bottom section is composed of metal of the first composition, wherein the top section is composed of metal of the second composition, wherein the middle section is composed of a mixture of metal of the first composition and the second composition, and wherein no oxide layer exists between the sections of the ingot.

2. A method of casting metal, comprising the following steps:

feeding molten metal of a first composition into a mold cavity, via a first control apparatus, wherein the molten metal of the first composition is an aluminum alloy, wherein the control apparatus is open, wherein the feeding comprises flowing out of a first feed chamber;

closing the first control apparatus;

opening a second control apparatus;

draining any molten metal of the first composition between the first feed chamber and the first control apparatus;

feeding molten metal of a second composition into the mold cavity, via the second control apparatus, wherein the molten metal of the second composition is an aluminum alloy, wherein at least a portion of the metal of the first composition in the mold cavity is sufficiently molten so that an initial feed of molten metal of the second composition mixes with the molten metal of the first composition in the mold cavity, wherein the feeding comprises flowing out of a second feed chamber, wherein the second composition is different from the first composition;

determining a first thickness of metal in the mold cavity;

closing the second control apparatus, in response to determining the first thickness;

determining a second thickness of metal in the mold cavity;

opening the first control apparatus, in response to determining the second thickness;

feeding molten metal of the first composition into the mold cavity, wherein at least a portion of the metal of the second composition in the mold cavity is sufficiently molten so that an initial feed of molten metal of the first composition mixes with the molten metal of the second composition in the mold cavity; and removing an ingot from the mold cavity after the molten metal solidifies wherein the solidification front remained substantially planar, wherein the ingot has a first layer, a second layer, a third layer, a fourth layer, and a fifth layer wherein the first and fifth layers are composed of metal of the first composition, wherein the third layer is composed of metal of the second composition, wherein the second and fourth layers are composed of a mixture of metal of the first composition and the second composition, and wherein no oxide layer exists between the layers of the ingot.

* * * * *